United States Patent [19]

Rodum

[11] Patent Number: 4,948,019

[45] Date of Patent: Aug. 14, 1990

[54] COLLAPSIBLE CLOTHES HANGER

[76] Inventor: Roland K. Rodum, 2870 Cobb St., NE., Marietta, Ga. 30068

[21] Appl. No.: 332,526

[22] Filed: Mar. 31, 1989

[51] Int. Cl.[5] ..... A47G 25/40; A47G 25/14

[52] U.S. Cl. ..... 223/94; 223/89; 223/88; 223/92

[58] Field of Search ..... 28/89, 90, 91, 94

[56] References Cited

U.S. PATENT DOCUMENTS

| | | | |
|---|---|---|---|
| 2,653,739 | 9/1953 | Zenk | 223/94 |
| 2,906,442 | 9/1959 | McNutt | 223/94 |
| 3,531,028 | 9/1970 | Vazquez | 223/94 |
| 4,673,115 | 6/1987 | LaMont | 223/94 |

*Primary Examiner*—Werner H. Schroeder
*Assistant Examiner*—Bibhu Mohanty
*Attorney, Agent, or Firm*—Louis T. Isaf

[57] ABSTRACT

A hanger apparatus comprises two arms spring-coupled to an extension of the hub of a swivel hook; which arms are equipped with interlocking elements to latch the hanger in a closed (folded) position; and whereby unlatching is achieved by a couple (twisting-moment) applied to the hub and the resulting relative motion between the elements disengages the arms, allowing the springs to open the hanger, and relatching is achieved by pushing the arms together until the elements reengage.

5 Claims, 3 Drawing Sheets

COLLAPSIBLE CLOTHES HANGER

FIELD OF THE INVENTION

This invention relates generally to the field of garment hangers.

BACKGROUND OF THE INVENTION

Department stores have traditionally used rigid hangers for top garments (blouses, coats, sweaters, and the like). For some types of garment, such as outercoats, they work well enough. For others, though, such as turtlenecks or shirts and blouses with small necks, they become inefficient in terms of speed of hanging. A further problem is that they often require plastic foam stretched over the hanger to prevent certain garments from sliding off. The labor required to apply these "foamies" further adds to the labor penalty. These factors, along with the entanglements which can hinder getting a hanger out of a box filled helter skelter with hangers, make a fresh view toward a more efficient device potentially rewarding.

SUMMARY OF THE INVENTION

Briefly described, the hanger of the present invention comprises two arms spring-coupled to an extension of the hub of a swivel hook. The arms are equipped with interlocking elements to latch the hanger in a closed (folded) position. Unlatching is achieved by a couple (twisting-moment) applied to the hub; and the resulting relative motion between the arms disengages the interlocking elements, allowing the springs to open the hanger. Relatching is achieved by pushing the arms together until the elements re-engage.

It is an object of the present invention to provide a hanger which is quick and easy to insert into a garment for hanging of the garment and quick and easy to remove from the garment.

Another object of the present invention is to provide a hanger which will fold and latch in the folded position; yet is easily unlatched and unfolded.

Yet another object of the present invention is to provide a hanger for bulk storing in a department store's storage box.

Other objects, features and advantages of the present invention will become apparent upon reading and understanding this specification, taken in conjunction with the accompanying drawings.

DETAILED DESCRIPTION

Figures 1, 6:
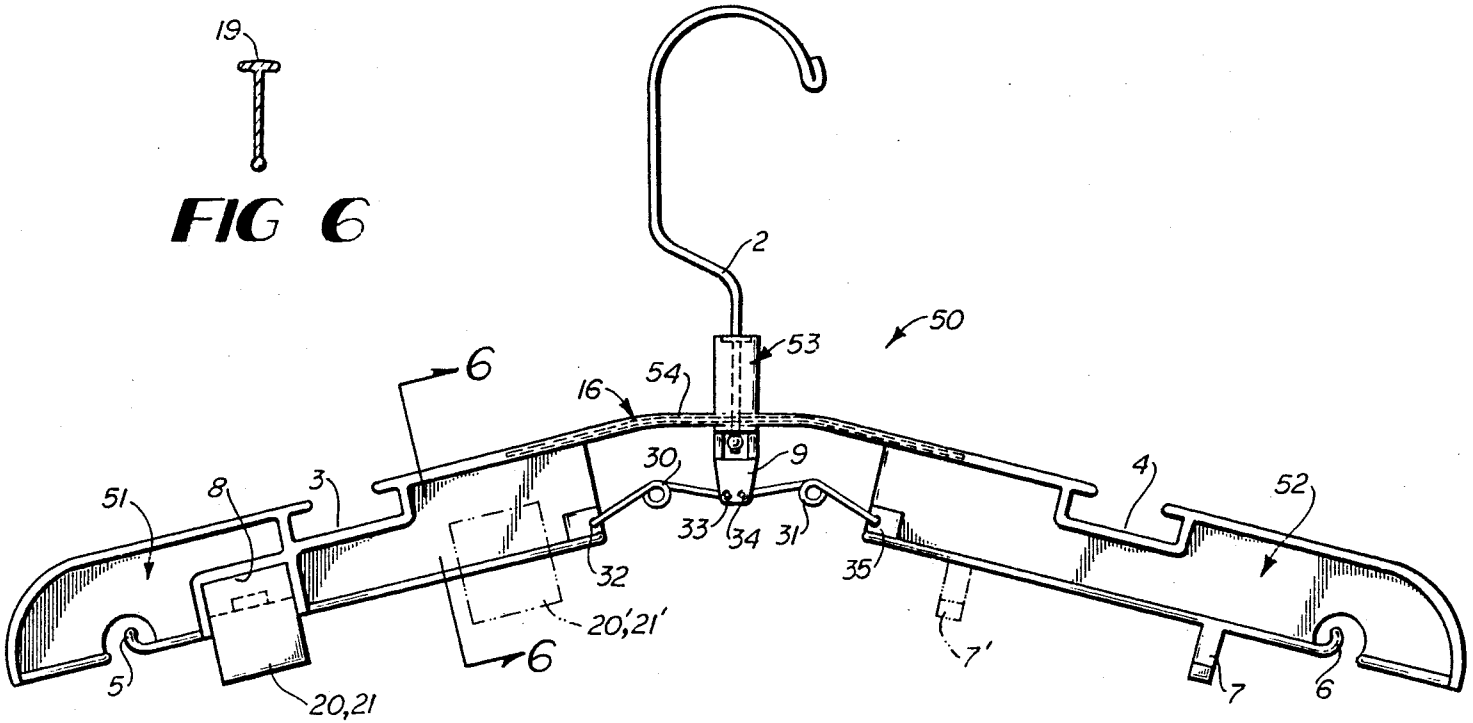
FIG. 1 is a side view of a hanger in accordance with the present invention, in the open position.
FIG. 6 is a sectional view taken along view VI—VI of FIG. 1.
Figure 2:
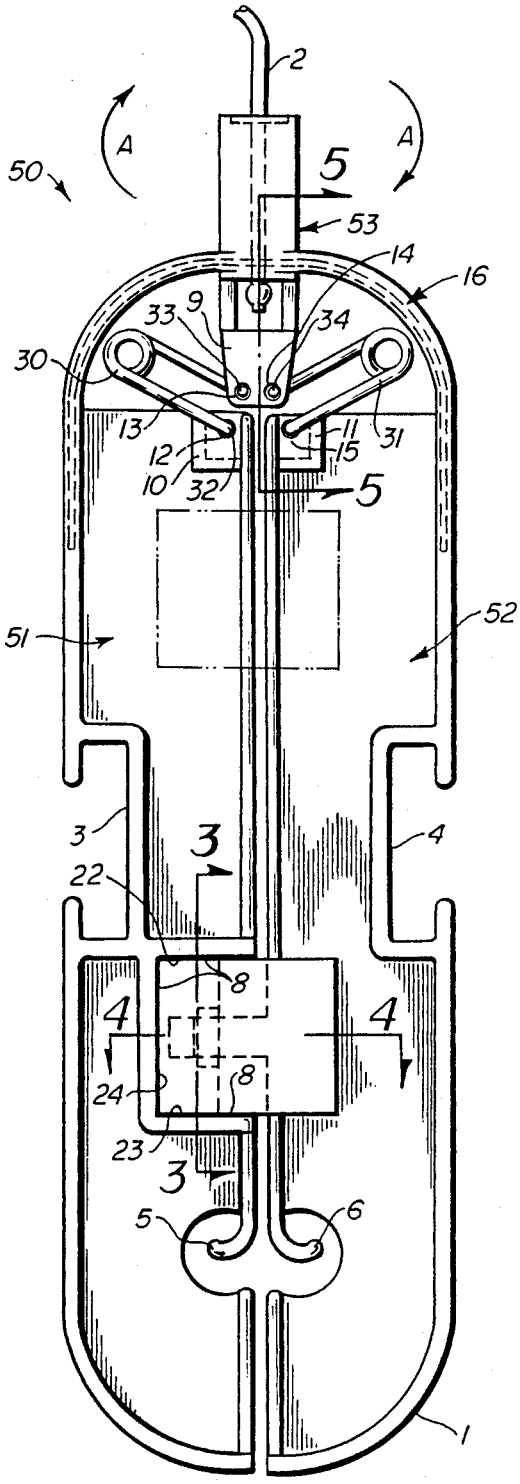
FIG. 2 is a side view of the hanger of FIG. 1, in the closed position.

Referring now in greater detail to the drawings, in which like numerals represent like components throughout the several views, a preferred embodiment of a hanger 50 of the present invention is seen in FIGS. 1 and 2 as including a hanger body 1 with the usual appurtenances of a department store garment hanger, namely a swivel hook 2, a left arm 51, a right arm 52 and features 3, 4, 5, 6 for hanging different-type garments. The swivel hook 2 is mounted within a hub portion 53. Bridging the left arm 51 and the right arm 52 is a flexible rib 54 which is rigidly connected at its ends to each of the arms. The hub portion 53 is supported at the flexible rib 54 thus supporting the arms 51, 52 from the hook 2. In the preferred embodiment, the arms 51, 52 and hub portion are a single molded unit (for example, plastic) integrally formed with and connected by the thin, flexible rib 54; and a leaf spring 16 (normally flat) is embedded in the rib 54 as reinforcement. In alternate embodiments, the leaf spring 16 serves as the flexible rib 54, itself, and it is appropriately connected at the arms 51, 52 and hub 53.

Figure 5:
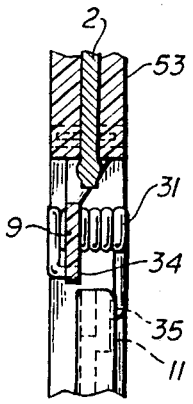
FIG. 5 is a isolated, sectional view, taken along view V—V of FIG. 2, and illustrating the springs in relation to the hub, in accordance with the present invention.
Figure 7:
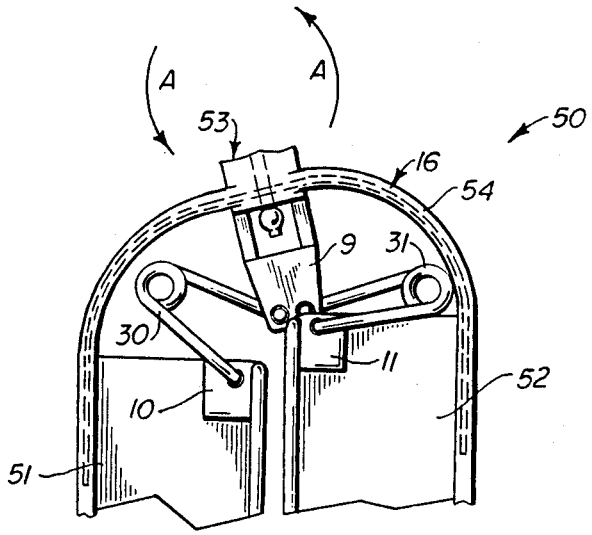
FIG. 7 is an isolated view of the hub area of the hanger of FIG. 2, representing the hub area at the point of releasing the hanger from the closed position.

The hub portion 53 defines a hub extension 9 to which are attached the inner ends 33, 34, respectively, of two springs 30, 31. The outer ends 32, 35, respectively, of the two springs 30, 31 are attached to the inner corners 10, 11, respectively, of the two hanger arms 51, 52. In preferred embodiments, the inner corners 10, 11 of the arms are staggered relative to the hub extension 9 (see FIG. 5) to provide clearance while unlatching (see FIG. 7). Holes 12, 13, 14, and 15 are spring attachment holes formed in the respective arms 51, 52 and hub extension 9.

Figure 3:
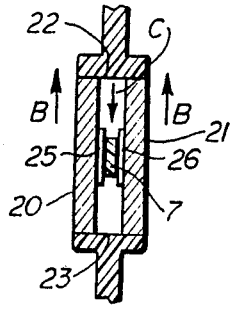
FIGS. 3 and 4 are isolated, sectional views taken along views III—III and IV—IV, respectively, of FIG. 2, isolating certain of the latching elements of the hanger in accordance with the present invention.
Figure 4:
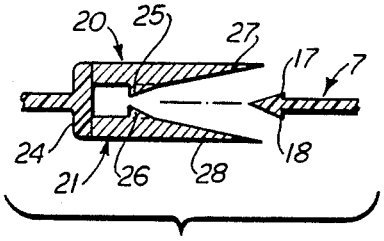

A latching prong 7 is formed into one arm 51; and a recess 8 is formed in the other arm 52 for alignment with the prong 7 when the hanger 50 is folded closed (see FIG. 2). Latching hooks 17 and 18 are molded into prong 7 (FIG. 4). Latching elements 20, 21 are mounted within the recess 8. The latching elements 20 and 21 (FIGS. 3 and 4) are, preferably, bonded to the body 1, as by chemical bond or other suitable bond, only at surfaces 22 and 23 (FIG. 3), not at surface 24 (FIG. 4). This permits the elements 20 and 21 to flex outward under the pressure of the prong hooks 17 and 18 engaging latching hooks 25 and 26, thereby saving wear on the hooks and prolonging the life of the hanger. A flare 27 and 28 in the inner surfaces of the latching elements 20, 21 provides an allowance for misalignment when latching the hanger.

In alternate embodiments, the outer surface 19 (FIG. 6) is provided with a special treatment or molded-in surface texture to assure good garment adhesion.

Whereas the hanger 1 is shown with the latching combination (prong 7 and latching elements 20, 21) in a certain location along the arms 51, 52, it is within the scope of the present invention to locate the latching combination at other locations (see for example prong 7' and latching elements 20', 21' shown in dotted lines on FIG. 1) along the arms in order to optimize alignment of the latching prong 7 and elements 20, 21 and resistance to the spring action. The spring 30, 31 strength is understood to be sufficient to retain the arms 51, 52 in the open position (FIG. 1) under the burden of a garment of selected weight.

Use: The hanger 1 of the present invention is, for example, normally kept closed (position of FIG. 2) when not in use. The prong 7 is "latched" by the latching elements 20, 21, through the interaction of the latching hooks 17, 18 and the engaging hooks 25, 26, to retain the hanger 1 in the closed position. The smaller profile reduces the possibility of entanglement with other hangers in storage. When hanging garments, one need only hold the neck of the garment open with one hand, slipping the closed hanger 1 in through the neck with the other hand, holding on to the swivel hook 2. When the hanger 1 is suitably positioned within the garment (for example, one arm 51 positioned as it will be with relation to one shoulder of the garment), a twist of the hub 53 unlatches the hanger, and the spring action of the coil springs 30, 31 spreads the arms 51, 52 apart to the open position (position of FIG. 1). A gentle shake will normally suffice to position the other arm in its place in the other shoulder of the garment.

The unlatching "twist" mentioned above is understood by reference to FIGS. 2 and 3. The hub portion 53 is grasped in one hand and is twisted about an axis perpendicular to the plane defined by the arms 51, 52 (i.e. about an axis perpendicular to the plane of the drawing FIG. 2) as represented by arrows "A" in FIG. 2, while bracing one arm of the hanger 1 with the hand holding the garment. (See, also, FIG. 7.) This twisting causes a relative movement between the prong 7 and the latching elements 20, 21, as represented by arrows "B" and "C" of FIG. 3. Thus, the latching hooks 17, 18 of the prong 7 are moved out of engagement with the engaging hooks 25, 26 of the latching elements 20, 21. (Note that the engaging hooks 25, 26 do not extend the full length of the latching elements 20, 21.) To remove the garment, collapsing the hanger while still in place allows easy removal.

Whereas the present invention has been described in detail with specific reference to particular embodiments thereof, it will be understood that variations and modifications can be effected within the spirit and scope of the present invention as hereinbefore described and as defined in the appended claims.

I claim:

1. A hanging apparatus for hanging garments and the like, said apparatus comprising:

a hook element for supporting the hanging apparatus from a bar or the like;

a hub portion to which is connected said hook element;

a first arm member and a second arm member, said first arm member and said second arm member being connected to said hub portion by flexible means for allowing pivotal movement of said arm members relative to said hub portion, said flexible means comprising, at least, a normally flat leaf spring interconnecting said first arm member, said second arm member and said hub portion;

a spring means for biasing said first arm member and said second arm member to an open position wherein said first and second arm members are spread apart from one another;

said spring means yielding to pressure on said arm members to move said arm members to a closed position wherein the first and second arm members are close together in approximate abutment; and releasable latching means for releasably retaining said first and second arm members in said closed position, whereby said arm members are returned to said open position by action of said spring means upon release of said retention by said latching means.

2. A hanging apparatus for hanging garments and the like, said apparatus comprising:

a hook element for supporting the hanging apparatus from a bar or the like;

a hub portion to which is connected said hook element;

a first arm member and a second arm member, said first arm member and said second arm member being connected to said hub portion by flexible means for allowing pivotal movement of said arm members relative to said hub portion, a spring means for biasing said first arm member and said second arm member to an open position wherein said first and second arm members are spread apart from one another, said spring means comprising, at least, a first coil spring connecting said first arm member and said hub portion, and a second coil spring connecting said second arm member and said hub portion, said spring means yielding to pressure on said arm members to move said arm members to a closed position wherein the first and second arm members are close together in approximate abutment; and releasable latching means for releasably retaining said first and second arm members in said closed position, whereby said arm members are returned to said open position by action of said spring means upon release of said retention by said latching means.

3. Hanging apparatus of claim 2, wherein said flexible means comprises, at least, a thin molded plastic rib interconnecting said first arm member, said second arm member and said hub portion.

4. Hanging apparatus of claim 2, wherein said flexible means comprises, at least, a normally flat leaf spring interconnecting said first arm member, said second arm member and said hub portion.

5. A hanging apparatus for hanging garments and the like, said apparatus comprising:

a hook element for supporting the hanging apparatus from a bar or the like;

a hub portion to which is connected said hook element;

a first arm member and a second arm member, said first arm member and said second arm member being connected to said hub portion by flexible means for allowing pivotal movement of said arm members relative to said hub portion, a spring means for biasing said first arm member and said second arm member to an open position wherein said first and second arm members are spread apart from one another;

said spring means yielding to pressure on said arm members to move said arm members to a closed position wherein the first and second arm members are close together in approximate abutment; and releasable latching means for releasably retaining said first and second arm members in said closed position, said releasable latching means comprising, at least, a prong member connected to and protruding from said first arm member;

prong engaging means associated with said second arm for engaging said prong member when said arm members are in said closed position, said engagement inhibiting relative movement of said prong member and said prong gripping means in a first direction, being the open arm direction; and means for disengaging the engagement of said prong member and said prong engaging means, said means for disengagement effecting relative movement of said prong member and said gripping assembly in a direction at an angle to said first direction, whereby said arm members are returned to said open position by action of said spring means upon release of said retention by said latching means.

* * * * *